US009453343B1

(12) United States Patent
Brinton et al.

(10) Patent No.: US 9,453,343 B1
(45) Date of Patent: Sep. 27, 2016

(54) SKYLIGHT MOUNTING SYSTEM AND ASSEMBLY

(71) Applicant: VKR HOLDING A/S, Hørsholm (DK)

(72) Inventors: James Eric Brinton, Mountville, SC (US); Charles Joseph Rimsky, Greenwood, SC (US); Michael James Waters, Greenwood, SC (US); Max LaForrest Sargent, Greenwood, SC (US); Jeffrey Joseph Ronan, Greenwood, SC (US); Alan John Ruhoff, Greenwood, SC (US); Steve Roy Kastner, Greenwood, SC (US); Gregory Foster Collins, Greenwood, SC (US); Brantlee Burnett Nickles, Waterloo, SC (US)

(73) Assignee: VKR HOLDING A/S, Horsholm (DK)

( * ) Notice: Subject to any disclaimer, the term of this patent is extended or adjusted under 35 U.S.C. 154(b) by 0 days.

(21) Appl. No.: 14/871,583

(22) Filed: Sep. 30, 2015

(51) Int. Cl.
*E04D 13/03* (2006.01)
*E04B 1/68* (2006.01)

(52) U.S. Cl.
CPC ..... *E04D 13/032* (2013.01); *E04B 1/6801* (2013.01); *E04D 13/033* (2013.01)

(58) Field of Classification Search
CPC ..... E04D 13/0305; E04D 13/0315; E04D 13/03; E04D 13/031; E04D 2013/0345; E04D 13/033; E04D 13/032; E04B 7/18; F16J 15/02; F16J 15/021; F16J 15/022
USPC ..... 52/200; 49/402, 475.1, 480.1, 484.1, 49/495.1, 498.1, DIG. 1, DIG. 2
See application file for complete search history.

(56) References Cited

U.S. PATENT DOCUMENTS 3,473,276 A * 10/1969 Back ..... E04D 13/03 52/200
4,073,097 A * 2/1978 Jentoft ..... E04D 13/0305 52/200
4,408,422 A * 10/1983 Bechtold ..... E04D 13/0305 52/200
4,409,767 A * 10/1983 Jentoft ..... E04D 13/0305 52/200
4,439,962 A * 4/1984 Jentoft ..... E04D 13/0305 49/DIG. 1

(Continued)

*Primary Examiner* — Brian Glessner
*Assistant Examiner* — Adam Barlow
(74) *Attorney, Agent, or Firm* — Timothy D. St. Clair; Nexsen Pruet, LLC

(57) ABSTRACT

A skylight mounting system and assembly is disclosed. The skylight mounting system of the present invention may include providing skylight assembly components and mounting such components to create the skylight assembly of the present invention. The components of the skylight assembly may include an upper frame having a downwardly extending upper channel, a lower frame having an upwardly extending lower channel, a connector clip, a gasket having a first and second gutter channel, and a lens. The lower frame may be secured to the gasket, the connector clip may be secured within the lower channel of the lower frame, the lens may be secured above the first and second gutter channels of the gasket, and an inside leg of the downwardly extending upper channel may be inserted into the connector clip secured within the lower channel of the lower frame.

22 Claims, 6 Drawing Sheets

(56) References Cited

U.S. PATENT DOCUMENTS 4,449,340 A * 5/1984 Jentoft ..... E04D 13/0354 428/515
4,466,221 A * 8/1984 Couture ..... E04D 13/0305 49/DIG. 1
4,514,943 A * 5/1985 Jentoft ..... E04D 13/0305 49/489.1
4,570,394 A * 2/1986 Jentoft ..... E04D 13/0354 49/DIG. 2
RE32,539 E * 11/1987 Jentoft ..... E04D 13/0305 49/DIG. 1
4,757,655 A * 7/1988 Jentoft ..... E04D 13/0305 49/DIG. 1
RE32,915 E * 5/1989 Jentoft ..... E04D 13/0305 52/200
4,862,657 A * 9/1989 Jentoft ..... E04D 13/0354 52/200
4,926,594 A * 5/1990 Sampson ..... E04D 13/0305 52/200
4,928,445 A * 5/1990 Sampson ..... E04D 13/0305 49/495.1
4,930,275 A * 6/1990 Verby ..... E04D 13/0305 49/DIG. 1
5,044,133 A * 9/1991 Sampson ..... E04D 13/0305 49/495.1
5,092,089 A * 3/1992 Kessler ..... E04D 13/0305 49/489.1
5,103,603 A * 4/1992 Verby ..... E04D 13/0354 52/200
5,148,643 A * 9/1992 Sampson ..... E04D 13/031 49/495.1
5,150,983 A * 9/1992 Bogenhagen ..... E04D 13/0305 403/295
5,199,234 A * 4/1993 Guhl ..... E04D 13/0315 52/200
5,207,036 A * 5/1993 Sampson ..... E04D 13/0354 49/402
5,355,644 A * 10/1994 Guhl ..... E04D 13/1415 52/200
5,669,186 A * 9/1997 Verby ..... E04D 13/035 52/200
5,913,785 A * 6/1999 Møller ..... E04D 13/0305 49/DIG. 1
7,331,145 B2 * 2/2008 Feucht ..... E04D 13/02 52/200
8,191,317 B2 * 6/2012 Lundsgaard ..... E04D 13/0354 49/349
2002/0095884 A1 * 7/2002 Lindgren ..... E04D 13/02 52/200
2010/0269426 A1 * 10/2010 Richter ..... E04D 13/0315 52/171.3
2012/0240491 A1 * 9/2012 Voegele, Jr. ..... E04D 13/0315 52/200
2013/0340362 A1 * 12/2013 Blomberg ..... E04D 13/032 52/200

* cited by examiner

SKYLIGHT MOUNTING SYSTEM AND ASSEMBLY

BACKGROUND

The present invention relates generally to a mounting system and assembly for a skylight. More particularly, the invention relates to a skylight mounting system that incorporates a skylight assembly having interfitting frames for easy assembly and a gasket configuration that drains condensation from the skylight cover.

Skylights are commonly incorporated into buildings, houses, and other structures. They often reduce energy consumption because they infuse desirable natural light into the interior of a structure, which thereby decreases dependency on artificial lighting. To exploit the benefits of using a skylight, it is preferred to maximize the amount of light entering the skylight's exterior cover.

A typical skylight system may include an exterior cover mounted on a building roof, an interior lens at the building interior, and a light channel disposed between the exterior cover and the interior lens. The exterior cover is affixed to the system with a mounting system.

Because of temperature differences between a building interior and the building's exterior environment that is bridged by a skylight, moisture condensation within a skylight can be a concern when selecting a particular skylight design.

Thus, there is a need for a skylight mounting system and assembly that drains condensation from the skylight cover while also maximizing the amount of light entering the lens of the skylight and allows for easy assembly.

SUMMARY

The present invention includes a skylight assembly. In one embodiment of the skylight assembly, the assembly may include an upper frame having a first surface and a first and a second downwardly extending leg from the first surface. The first and second downwardly extending legs of the upper frame may define an upper channel therebetween. The skylight assembly also may include a lower frame having a second surface and a first and a second upwardly extending leg from the second surface. The first and second upwardly extending legs of the lower frame may define a lower channel therebetween. The lower frame further may include a downwardly extending leg from the second surface. The skylight assembly may also include a connector clip for securing the upper frame to the lower frame and a gasket secured to the surface of the lower frame. Further, the skylight assembly may include a first lens secured between the upper frame and the gasket.

In an alternative embodiment of the skylight assembly, the assembly may include a frame and a gasket. In this embodiment, the gasket may include a first lateral surface and a second lateral surface resides below the first lateral surface. The first lateral surface may include a first end and a second end wherein the first end may be disposed adjacent to the frame. The first lateral surface further may include respective first, second, and third longitudinal members. The first longitudinal member may be disposed positioned at the first end of the first lateral surface and may extend upwardly from the first lateral surface. The third longitudinal member may be disposed at the second end of the first lateral surface and may include an upwardly extending leg from the first lateral surface. The second longitudinal member may include an upper end and a lower end and may intersect the first lateral surface between the first and third longitudinal members. The second lateral surface may extend outwardly from the lower end of the second longitudinal member. The skylight assembly may also include a lens secured between the frame and the gasket.

The present invention also includes a method of mounting a skylight system. The system may include providing skylight assembly components which may include an upper frame having a downwardly extending upper channel and inside and outside legs bordering the channel, a lower frame having an upwardly extending lower channel, a connector clip, a gasket having a first gutter channel and a second gutter channel, and a lens. The method of mounting a skylight system further may include mounting the skylight assembly components, which may include the steps of securing the lower frame to the gasket, securing the connector clip within the lower channel of the lower frame, securing the lens above the first and second gutter channels of the gasket, and inserting the inside leg of the downwardly extending upper channel into the connector clip secured within the lower channel of the lower frame.

DETAILED DESCRIPTION OF REPRESENTATIVE EMBODIMENTS

The present invention relates to a skylight mounting system and assembly. The skylight mounting system and assembly of the present invention controls and drains moisture condensate upon the interior of the skylight exterior cover. The skylight mounting system and assembly also maximizes the amount of light transmitted into the light channel and building interior. Additionally, the skylight mounting system and assembly of the present invention preferably allows for easy assembly.

The composition, components, materials, sizes, and shapes of the skylight mounting system and assembly may vary. For example, the apparatus may vary depending upon size and shape of the curb upon which the assembly is mounted. Additionally, the apparatus may vary depending upon the degree of incline of the mounting surface, the potential moisture levels for a particular mounting environment, and the amount of desired natural light sought to be infused into a structure. Although primarily described herein in terms of its use to increase natural light within a structure and to decrease energy consumption, it will be clear that the apparatus and method of the present invention may provide additional benefits. Further, the primary components of the skylight mounting system and assembly as described herein may be combined with additional components and materials without departing from the spirit and the scope of the present invention. The invention will be described with reference to the figures which are an integral non-limiting component of the invention. Throughout the description similar elements will be numbered accordingly.

Figure 1:
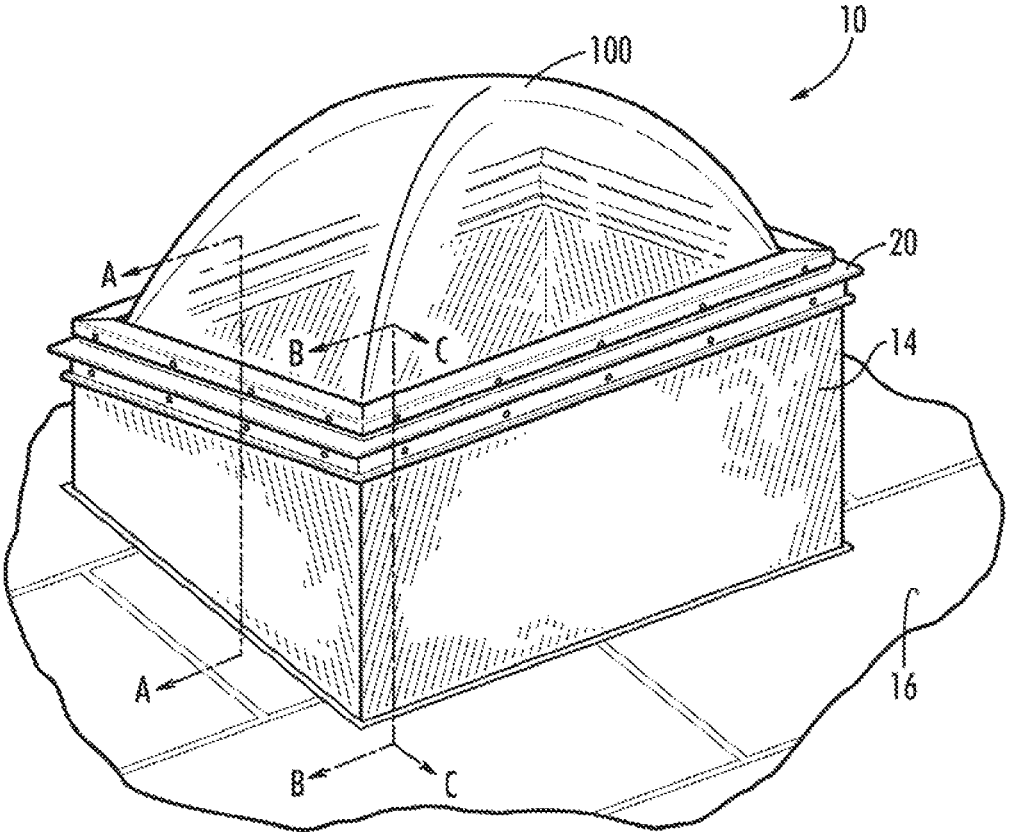
FIG. 1 is a perspective view of an embodiment of the skylight assembly of the present invention secured to a curb and a roof structure.

FIG. 1 discloses an embodiment of an assembled skylight assembly 10 of the present invention. As shown, the skylight assembly includes a frame 20 and at least one lens 100. The frame 20 is preferably for securing to a skylight curb 14 that may be built on the top of a roof structure 16. The skylight assembly 10 may form a number of different shapes. For example, in the illustrated embodiment, the skylight assembly is generally rectangular. In alternative embodiments of the present technology, however, the skylight assembly may be of shapes other than rectangular. Furthermore, the skylight assembly may be mounted on a horizontal or angled roof structure.

Figure 2:
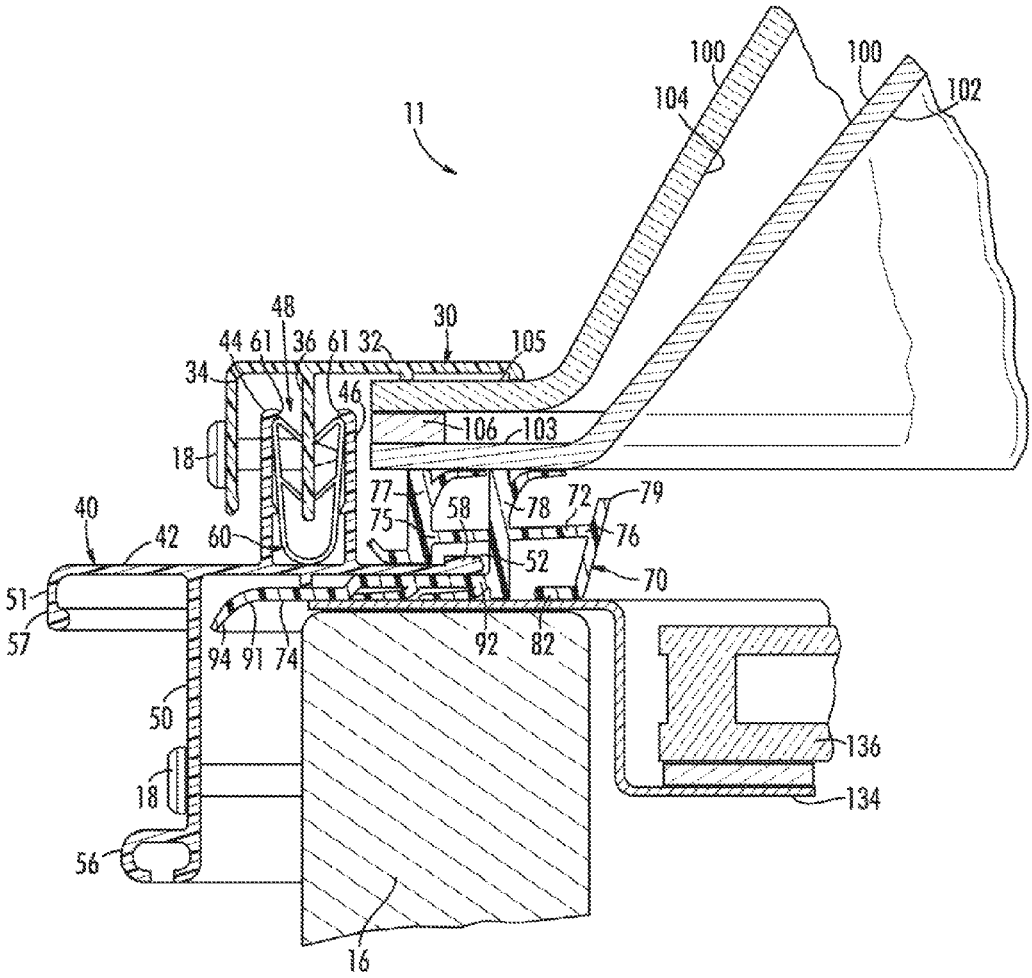
FIG. 2 is a cross-sectional elevation view, taken at A:A in FIG. 1, of an embodiment of the skylight assembly of the present invention secured to a curb.
Figure 3:
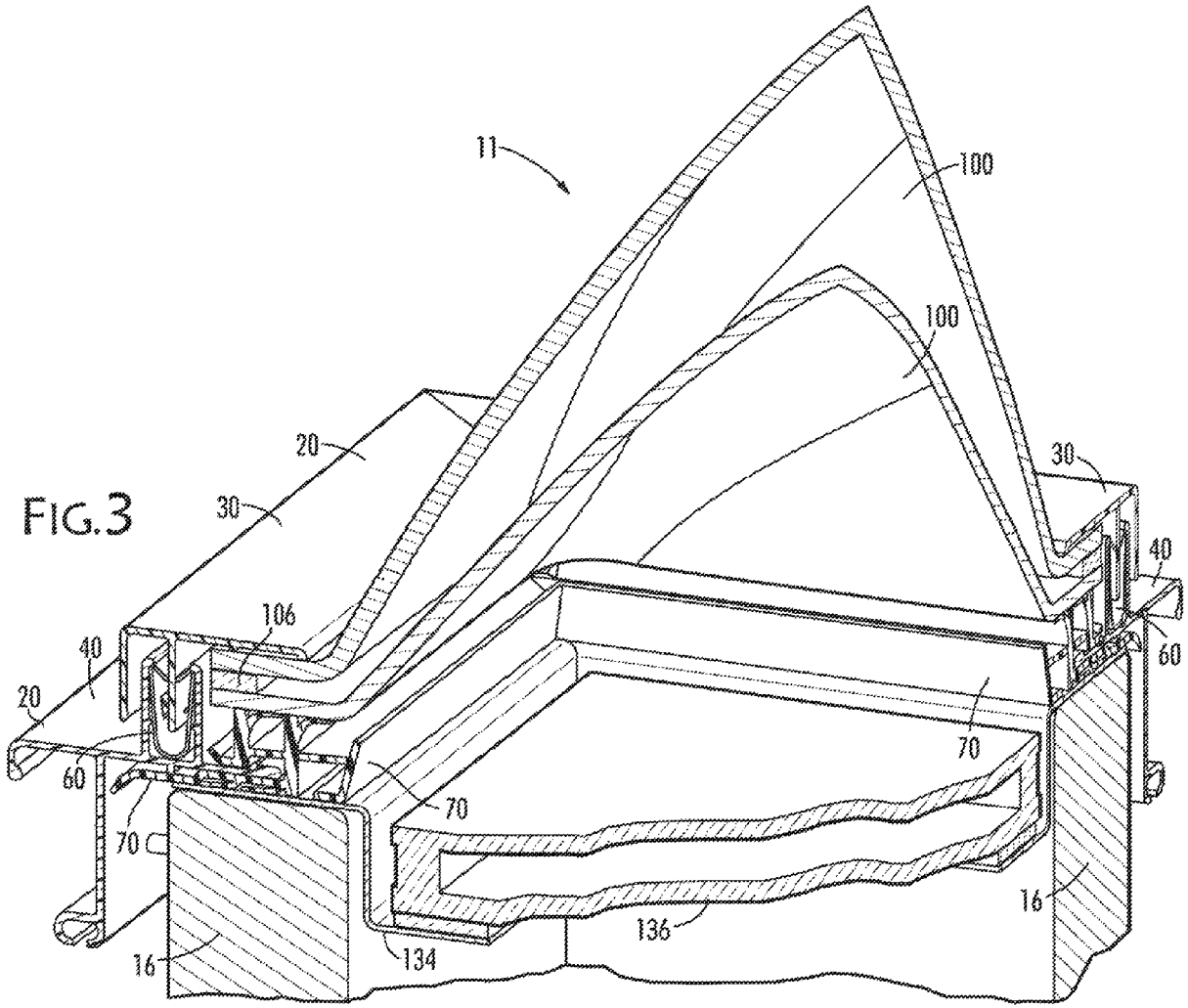
FIG. 3 is a perspective cross-sectional view, taken at B:B, C:C in FIG. 1, of an embodiment of the skylight assembly of the present invention secured to a curb.

FIG. 2 discloses a side view of a cross-sectional cut-out portion 11 of an embodiment of the assembled skylight assembly 10 of the present invention. FIG. 3 discloses a perspective view of a cut-out portion 11 of an embodiment of the assembled skylight assembly 10 of the present embodiment. As illustrated in the embodiments of FIGS. 2 and 3, the skylight assembly may include a frame 20 for securing to a curb 16, a gasket 70, and at least one lens 100.

As discussed above, the skylight assembly may include a frame 20. In the embodiments of FIGS. 2 and 3, the frame 20 includes an upper frame 30 and a lower frame 40. As shown in the exploded view of FIG. 4, which discloses the cut-out portion 11 of exemplary components of the skylight assembly 10 of the present invention, the upper frame 30 may include a surface 32 and first and second legs 34, 36, respectively, that extend downwardly from the surface 32. In the illustrated embodiment, the surface is generally planar. The first and second downwardly extending legs 34, 36, respectively, combined with a portion of the surface 32, preferably form a channel 38 therebetween. Because the legs 34, 36 extend downwardly from the surface 32, channel 38 likewise opens downwardly. In the embodiment of FIG. 2, the first downwardly extending leg 34 and the second downwardly extending leg 36 of the upper frame 30 are parallel to each other and perpendicular to the surface 32 of the upper frame 30.

The lower frame 40 preferably includes a surface 42 having a first end 51 and a second end 52. Like surface 32, surface 42 may also be generally planar. The lower frame 40 also preferably includes first and second legs 44, 46 that extend upwardly from the surface 42. The first and second legs 44, 46, combined with a portion of the surface 42, may form a channel 48 therebetween. Because legs 44, 46 extend upwardly from the surface 42, channel 48 likewise opens upwardly. In the embodiment of FIG. 2, first and second legs 44, 46, respectively are positioned between the first and second ends 51, 52, respectively, of the surface 42 of the lower frame 40. Further, the first upwardly extending leg 44 and the second upwardly extending leg 46 of the lower frame 40 are preferably parallel to each other and perpendicular to the surface 42 of the lower frame 40.

As shown in the embodiment of FIG. 2, the lower frame also preferably includes a downwardly extending leg 50 from the surface 42. In the embodiment shown in FIG. 2, the downwardly extending leg 50 is also positioned between first and second ends 51, 52, respectively, of the surface 42 of the lower frame 40. Leg 50 may be positioned adjacent to a curb 16 on a structure and may be used to secure the skylight assembly to a structure. Leg 50 therefore may include openings for insertion of securing mechanisms 18, such as screws or nails. Additionally, because the lower portion of leg 50 may be exposed around the curb 16, a termination 56 may be incorporated at the bottom of leg 50 to strengthen leg 50 against flexing outwardly from curb 16 or inwardly toward curb 16. Terminations, such as termination 56, may assist with the management of rainfall, sleet, or snow away from the skylight assembly 10.

The surface 42 of lower frame 40 may include an arcuate termination 57 at the first end 51 of the surface 42, such as shown in FIG. 2. The arcuate termination 57 to strengthen first end 51 and to assist with the management of rainfall, sleet, or snow away from the skylight assembly 10. The second end 52 of the surface 42 may include a tab 58. By its shape, tab 58 may be used for securing the gasket 70 to the lower frame 40, such as shown in FIG. 2 and as further discussed below.

As shown in FIG. 2, an embodiment of the skylight assembly of the present invention further may include a connector clip 60. The connector clip preferably secures the upper frame 20 to the lower frame 30, or vice-versa. Thus, as shown in FIG. 2, the legs forming the channel where the connector clip is being inserted preferably includes ridges 61 at its ends to secure the connector clip 60 within the channel, such as channel 48, such as by snap-fit engagement with connector clip 60.

Figure 4:
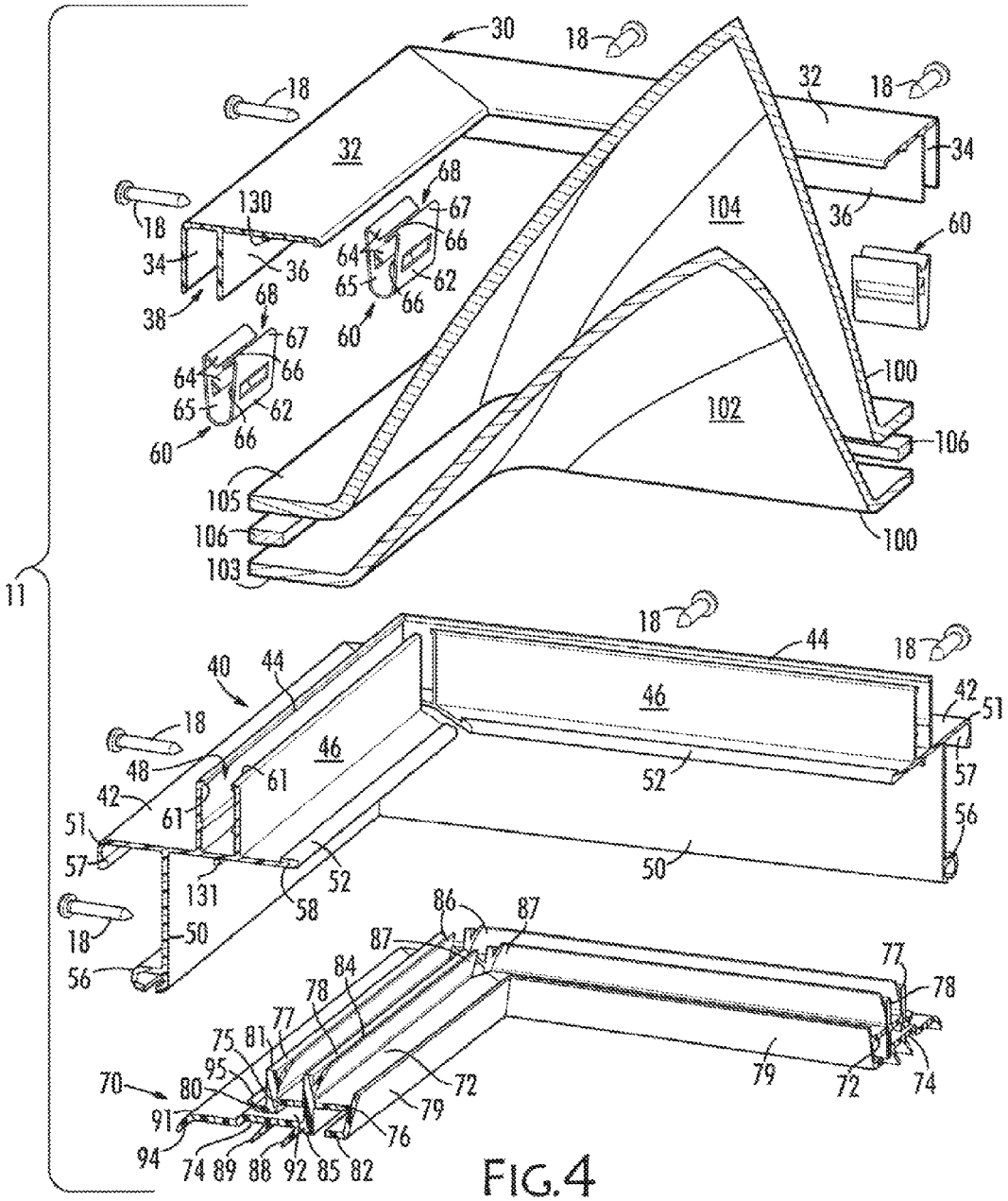
FIG. 4 is an exploded cross-sectional view of selected components of the skylight assembly of FIG. 3.

In the embodiment of FIG. 4, the connector clip may include an outer body 62 that may form a generally U-shape. Additional shapes are contemplated without departing from the spirit and the scope of the present invention. As shown in FIG. 4, the outer body 62 may include extenders 64 extending inward from a first side 65 of the outer body 62 and extenders 66 extending inward from a second side 67 of the outer body 62. The extenders 64 and 66 may angle towards each other and depend downwardly to form a V shape with a slot 68 at the apex therebetween. In the embodiment of FIG. 4, two extenders 64 extend inwardly and are formed from the first side 65 of the outer body 62 and two extenders 66 extend inwardly and are formed from the second side 67 of the outer body 62. In an alternative embodiment, a single extender may extend from each side 65, 67 of the outer body 62. In yet another alternative embodiment, three or greater extenders may extend from each side 65, 67 of the outer body 62.

In the illustrated embodiments, the connector clip 60 is a separable component from the frame 20. In an alternative embodiment, the connector clip may be integrally formed within a channel 48. For example, extenders 64 and 66 may be formed directly along the legs 44 and 46 of lower frame 40 within channel 48. Further, in one embodiment, multiple connector clips 60 may be inserted along a length of a channel. In an alternative embodiment, a single connector clip 60 may be inserted within a channel and the connector clip 60 may or may not extend the entire length of the channel.

In the embodiments of FIGS. 2 and 4, the connector clip 60 is inserted within the channel 48 of the lower frame 40 of the skylight assembly 10. The extenders 64 and 66 depend downwardly into the channel 48. Leg 36 of upper frame 30 may be inserted into the slot 68 of connector clip 60 to secure the upper frame to the lower frame. Alternatively, the connector clip 60 may be inserted within the channel 38 of the upper frame 30 of the skylight assembly 10. In this alternative embodiment, the extenders 64 and 66 may extend upward into the channel 38. Leg 44 of lower frame 40 may be inserted into the slot 68 of connector clip 60 to secure the upper frame to the lower frame.

In addition to the connector clip 60, the upper frame 30 and lower frame 40 may also be secured using securing mechanisms 18, such as bolts, screws, or the like. As shown in FIG. 2, aligned openings may be incorporated into leg 34 of upper frame 30 and leg 44 of lower frame 40. A securing mechanism 18 may be inserted through the openings to secure the upper frame 30 to the lower frame 40. Furthermore, the components of the present invention may be secured using adhesives between the respective components. For example, adhesive may be incorporated between surface 32 of upper frame 30 and lens 100 where those components overlap.

As discussed above, the skylight assembly 10 preferably further includes a gasket 70 secured to the frame 20. Gasket 70 preferably seals the skylight assembly from air and water leakage and creates gutters for moisture and condensation control and flow away from lens 100.

In the embodiment of FIG. 2, the gasket 70 may include an upper lateral surface 72 and a lower lateral surface 74. The upper lateral surface 72 may include a first end 75 and a second end 76 wherein the first end 75 may be positioned adjacent to the frame 20. The upper lateral surface 72 may also include longitudinal members 77, 78, 79. In the embodiment of FIG. 2, three longitudinal members may be incorporated. The first longitudinal member 77 may include a base 80 and a top 81 wherein the base may be positioned adjacent to the upper lateral surface 72. The first longitudinal member 77 may be positioned at the first end 75 of the upper lateral surface 72 and may at least extend upward from the upper lateral surface 72. The third longitudinal member 79 may be positioned at the second end 76 of the upper lateral surface 72. As shown, the third longitudinal member 79 may extend both upwardly and downwardly from the upper lateral surface 72. In one embodiment, the third longitudinal member may be L-shaped and may include a leg 82 that extends laterally from the bottom of third longitudinal member 79. The second longitudinal member 78 may include an upper end 84 and a lower end 85 and intersect the upper lateral surface 72 between the first and third longitudinal members 77 and 79, respectively. The lower lateral surface 74 may extend outward from the lower end 85 of the second longitudinal member 78.

Gasket 70 may further include angled wings. As illustrated in FIG. 2, a first angled wing 86 may be positioned at the top of the first longitudinal member 77. A second angled wing 87 may be positioned at the upper end 84 of the second longitudinal member 78. A third angled wing 88 may be positioned below the lower lateral surface 74. Further, a fourth angled wing 89 may be positioned below the lower lateral surface 74 and adjacent to the third wing 88. In one embodiment, the angled wings are composed of flexible material, such a rubber-based material.

Figure 5:
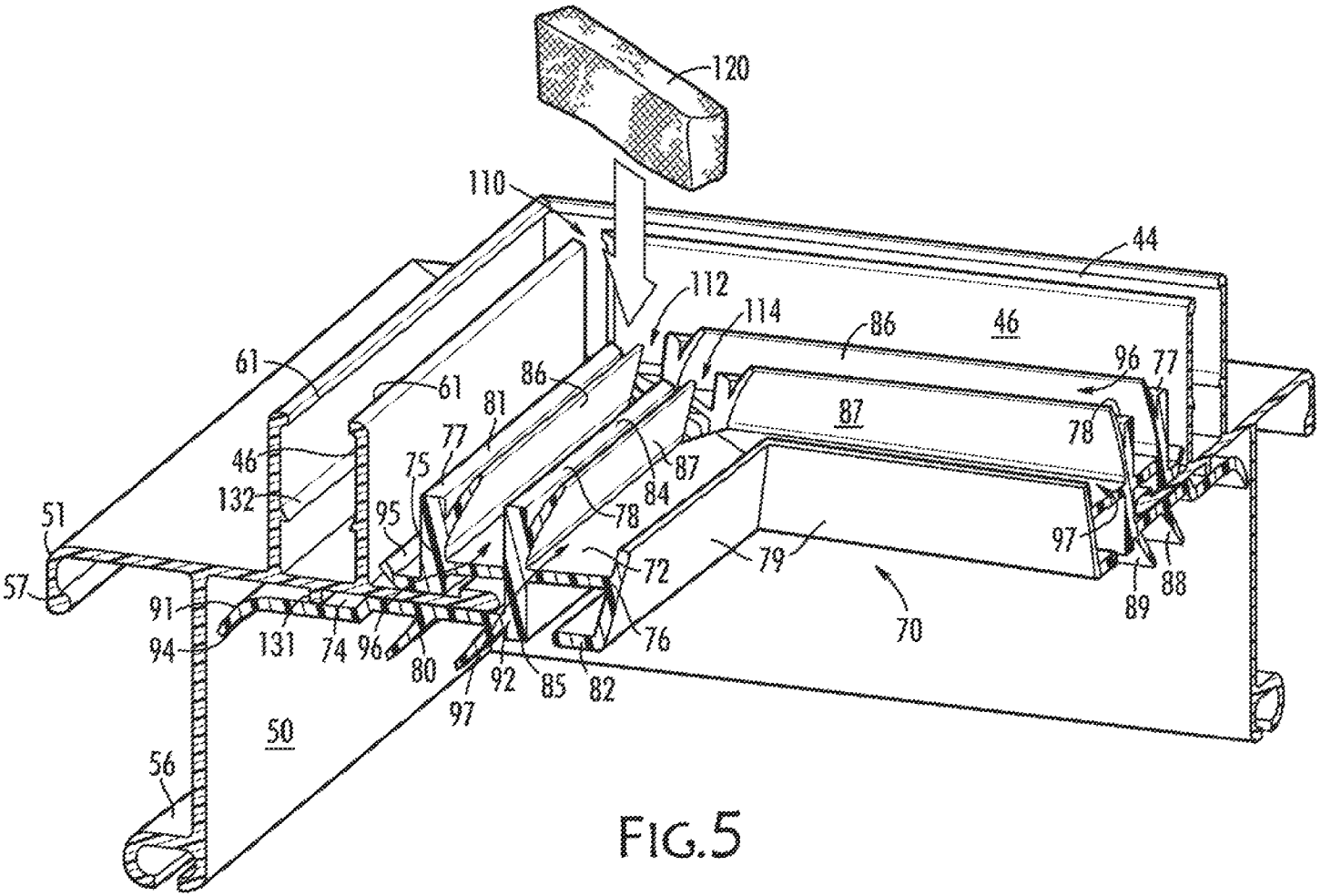
FIG. 5 is a exploded cross-sectional view of selected components of the embodiment of the skylight assembly of FIG. 3.

The lower lateral surface 74 as illustrated in FIGS. 2, 4, and 5 may include a first end 91 and a second end 92. The second end 92 of the lower lateral surface 74 may be adjacent to the lower end 85 of the second longitudinal member 78. Further, the first end 91 of the lower lateral surface 74 may include a downward sloped leg 94. Additionally, the first longitudinal member 77 may also include an arced leg 95. To assist with moisture drainage, arced leg 95 may extend upwardly to create a valley for moisture retention and flow.

The skylight assembly 10 preferably further includes a at least one lens 100. Lens 100 may be flat, slightly angled, dome-shaped such as shown in FIG. 1, or of any other advantageous configuration. Indeed, practically any lens shape may work with the present invention without departing from the scope herein.

In the embodiments shown in FIGS. 2 and 3, an inner lens 102 and an outer lens 104 are incorporated and together may form the cover of the skylight assembly. When multiple lenses are used, a spacer 106 may be used. For example, as shown in FIG. 2, the horizontal surfaces 103 and 105 of inner lens 102 and outer lens 104, respectively, may be separated by a spacer 106. The spacer 106 may provide a cushion between the lenses 102 and 104. In one embodiment, the spacer 106 may be composed of a foam material, such as a dosed cell foam pad. The spacer may be adhesively secured to the horizontal surfaces 103 or 105. For example, the spacer 106 may extend around the entire outer circumference of a horizontal surface of a lens 102. In an alternative embodiment, multiple spacers may be inserted at varying locations around the outer circumference of a lens 102.

In the embodiments of FIGS. 2 and 3, the horizontal surfaces 103 and 105 of lenses 102 and 104 may be secured between the upper frame 30 and the gasket 70, respectively. In one embodiment, adhesive may be used to secure the lens 100 to the upper frame and/or gasket. In another embodiment, frictional and/or compressive forces may secure the lens 100 to the upper frame and/or gasket.

As shown in FIG. 2, the gasket 70 may be secured to the surface 42 of the lower frame 40 between the upper lateral surface 72 and the lower lateral surface 74 of gasket 70. In the illustrated embodiment, the gasket may be secured to the lower frame 40 by tab 58 of surface 42, which may be inserted between lower lateral surface 74 and the base 80 of first longitudinal member 77. Once tab 58 is moved past the first longitudinal member 77, tab 58 may become fixed within the gasket between the upper lateral surface 72 and the lower lateral surface 74, with first longitudinal member 77 urging tab 58 from sliding out of gasket 70.

As most easily shown in FIG. 5, the first longitudinal member 77, the second longitudinal member 78, and the upper lateral surface 72 of the gasket 70 may form a first gutter 96. Further, the second longitudinal member 78, the third longitudinal member 79, and the upper lateral surface 72 of the gasket 70 may form a second gutter 97.

Figure 6:
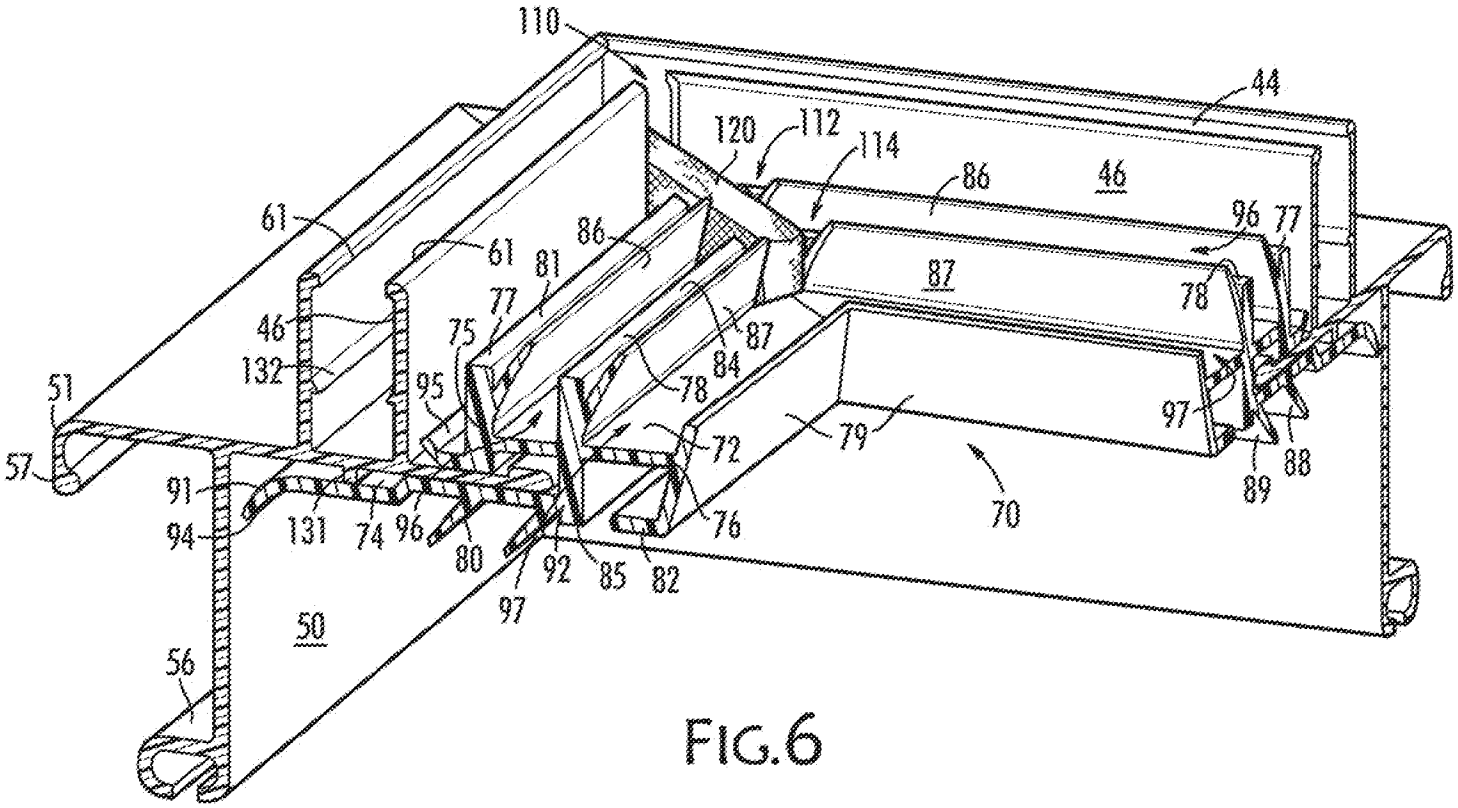
FIG. 6 is a perspective cross-sectional view of selected components of the embodiment of the skylight assembly of FIG. 3.

The skylight assembly 10 of the present invention may include multiple sides with angles therebetween to form its outer shape. In the embodiment of FIG. 5, for example, the cut-out portion 11 includes a right angle, which may signify a rectangularly-shaped skylight assembly 10, such as shown in FIG. 1. At this angle, a gap 110 may be formed in leg 46 of lower frame 40. Further, gaps 112 and 114 may be formed at this angle in longitudinal member 77 and longitudinal member 78, respectively. Because longitudinal members 77 and 78 of the embodiment shown in FIG. 5 include angled wings 86 and 87, respectively, gaps 112 and 114 extend through angled wings 77 and 78. Gaps 110, 112, and 114 may allow for insertion of a wick 120, typically composed of a moisture-absorbent material. In one embodiment, the wick 120 may be a polyester material, such as polyethylene terephthalate. In an alternative embodiment the wick 120 may be a cotton material. As shown in FIG. 6, wick 120 may be inserted into gaps 110, 112, and 114. Alternatively, the wick may be only inserted into gaps 112 and 114.

When moisture is present on the inside of the skylight assembly 10, such as interior to inner lens 102, gravity may drive the moisture down to gasket 70 typically at gutter 96 and/or 97. The moisture will travel through gutter 96 or 97 toward the wick 120. When moisture reaches wick 120, wick 120 pull the moisture through gaps 110, 112, and 114, as the case may be, to the exterior of skylight assembly 10. Alternatively, should environmental factors, such as wind or such as higher ambient pressure outside of skylight system 10, drive moisture outside of skylight assembly 10 toward the interior of skylight assembly 10, wick 120 impedes such moisture from entering the interior of skylight system 10.

Preferably, no gaps are included in leg 44 of lower frame 40 or third longitudinal member 79 of gasket 70. This configuration preferably allows for increased moisture control away from the lenses 100 because the elimination of gaps in leg 44 of lower frame 40 forecloses pathways for moisture to enter into the skylight assembly 10 from the outside. Further, gaps in third longitudinal member 79 are likewise unnecessary, and eliminating such gaps limits moisture seepage from the wick 120 back toward the lens.

Strengthening and/or compression ribs may be incorporated along frame 20 without departing from the scope of the present invention. For example, as shown in FIG. 4, a rib 130 may be incorporated along the underside of surface 32 of upper frame 30. As shown in FIG. 2, rib 130 is positioned above the horizontal surface 105 of upper lens 104. Further, as shown in FIG. 4, another rib 131 may be positioned along the underside of surface 42 of lower frame 40 at the center of and below channel 48. Ribs 132 may also be incorporated within channel 48 along legs 44 and 46.

Optional accessories may be incorporated into the skylight assembly 10 of the present invention without departing from the spirit and scope of the present invention. For example, as shown in FIG. 3, a tray 134 and diffuser 136 may be incorporated. Alternatively, for example, an insulated glazing unit may be incorporated into tray 134.

The skylight mounting system of the present invention incorporates the skylight assembly 10 as described above and preferably provides for constructing the skylight assembly 10 described above. For example, the skylight assembly 10 may be constructed by forming the skylight assembly components discussed above. Particularly, an upper frame having a downwardly extending upper channel is preferably formed as well as a lower frame having an upwardly extending lower channel. A connector clip, lens, and a gasket having a first gutter channel and a second gutter channel are also preferably formed. The skylight assembly components may then be secured together. For example, the lower frame may be secured to the gasket. Further, the connector clip may be secured within the lower channel of the lower frame and the lens may be secured above the first and second gutter channels of the gasket. Also, an inside leg of the downwardly extending upper channel may be inserted into the connector clip to secure the upper frame within the lower channel of the lower frame to create an embodiment of the skylight assembly 10 of the present invention. Additionally, the skylight mounting system provides for securing the skylight assembly to a curb on a roof structure.

The skylight mounting system and assembly of the present invention is particularly suitable for use with many different types and forms of structures, including commercial, industrial, and residential structures. Further, the frame design of the skylight mounting system and assembly of the present invention preferably provides a lower height profile than most known skylight systems and therefore allows for increased light into one or more lenses of the skylight assembly. Additionally, the skylight assembly design preferably provides a decreased frame width from most known skylight systems and therefore further allows for increased light into one or more lenses of the skylight assembly. Moreover, as discussed above, the inventive gutter and wick design of the gasket of the skylight assembly preferably decreases and limits the flow of moisture and condensation onto a lens of the skylight assembly of the present invention.

While various embodiments and examples of this invention have been described above, these descriptions are given for purposes of illustration and explanation, and not limitation. Variations, changes, modifications, and departures from the apparatuses, systems, and methods disclosed above may be adopted without departure from the spirit and scope of this invention. In fact, after reading the above description, it will be apparent to one skilled in the relevant art(s) how to implement the invention in alternative embodiments. Thus, the present invention should not be limited by any of the above described exemplary embodiments.

Further, the purpose of the Abstract is to enable the various Patent Offices and the public generally, and especially the scientists, engineers, and practitioners in the art who are not familiar with patent or legal terms or phraseology, to determine quickly from a cursory inspection the nature and essence of the technical disclosure of the application. The Abstract is not intended to be limiting as to the scope of the invention in any way.

What is claimed is:

1. A skylight assembly for securing to a curb, the assembly comprising:

an upper frame, the upper frame comprising a first surface and a first and a second downwardly extending leg from the first surface, the first and second downwardly extending legs of the upper frame defining an upper channel therebetween;

a lower frame, the lower frame comprising a second surface and a first and a second upwardly extending leg from the second surface, the first and second upwardly extending legs of the lower frame defining a lower channel therebetween, the lower frame further comprising a downwardly extending leg from the second surface;

a connector clip for securing the upper frame to the lower frame, wherein the connector clip forms a generally U-shape and includes at least two extenders angled downward towards each other into the generally U-shape of the connector clip;

a gasket, the gasket secured to the surface of the lower frame; and a first lens, the first lens secured between the upper frame and the gasket.

2. The assembly of claim 1 further comprising a second lens residing below the first lens and separated by a spacer inserted therebetween, the second lens being disposed on the gasket.

3. The assembly of claim 1 wherein the connector clip is secured within the lower channel of the lower frame, the first downwardly extending leg of the upper frame disposed between the at least two extenders of the connector clip.

4. The assembly of claim 1 wherein the first downwardly extending leg and the second downwardly extending leg of the upper frame are parallel to each other and perpendicular to the first surface of the upper frame.

5. The assembly of claim 1 wherein the first upwardly extending leg and the second upwardly extending leg of the lower frame are parallel to each other and perpendicular to the second surface of the lower frame.

6. A skylight assembly for securing to a curb, the assembly comprising:

an upper frame, the upper frame comprising a first surface and a first and a second downwardly extending lea from the first surface, the first and second downwardly extending legs of the upper frame defining an upper channel therebetween;

a lower frame, the lower frame comprising a second surface and a first and a second upwardly extending lea from the second surface, the first and second upwardly extending legs of the lower frame defining a lower channel therebetween, the lower frame further comprising a downwardly extending lea from the second surface;

a connector clip for securing the upper frame to the lower frame;

a gasket, the gasket secured to the surface of the lower frame, the gasket comprises a first lateral surface and a second lateral surface disposed therebelow, the first lateral surface including a first end and a second end wherein the first end is positioned adjacent to the frame, the first lateral surface further including respective first, second, and third longitudinal members, the first longitudinal member being disposed at the first end of the first lateral surface and extending upwardly from the first lateral surface, the third longitudinal member being disposed at the second end of the first lateral surface and including an upwardly extending leg and a downwardly extending leg from the first lateral surface, the second longitudinal member including an upper end and a lower end and intersecting the first lateral surface between the first and third longitudinal members, the second lateral surface extending outwardly from the lower end of the second longitudinal member; and a first lens, the first lens secured between the upper frame and the gasket.

7. The assembly of claim 6 wherein the gasket further includes two angled wings, wherein the first angled wing extends from the first longitudinal member and the second angled wing extends from the upper end of the second longitudinal member.

8. The assembly of claim 7 wherein the gasket further comprises a third angled wing disposed below the second lateral surface.

9. The assembly of claim 6 wherein the first longitudinal member, the second longitudinal member, and the first lateral surface of the gasket form a first gutter, and wherein the second longitudinal member, the third longitudinal member, and the first lateral surface of the gutter form a second gutter.

10. The assembly of claim 9 further comprising a corner and a wick, the first and second gutters of the gasket defining gaps, wherein the wick resides in a gap.

11. A skylight assembly comprising:

a frame;

a gasket secured to the frame, the gasket comprising a first lateral surface and a second lateral surface disposed below the first lateral surface, the first lateral surface including a first end and a second end wherein the first end is positioned adjacent to the frame, the first lateral surface further including respective first, second, and third longitudinal members, the first longitudinal member being disposed at the first end of the first lateral surface and extending upwardly from the first lateral surface, the third longitudinal member being disposed at the second end of the first lateral surface and including an upwardly extending leg from the first lateral surface, the second longitudinal member including an upper end and a lower end and intersecting the first lateral surface between the first and third longitudinal members, the second lateral surface extending outwardly from the lower end of the second longitudinal member, wherein the first longitudinal member includes a base and a top, the base positioned at the first lateral surface, wherein the gasket further includes first, second, and third angled wings wherein the first angled wing is positioned at the top of the first longitudinal member, the second angled wing is positioned at the upper end of the second longitudinal member, and the third angled wing is positioned below the second lateral surface; and a lens residing between the frame and the gasket.

12. The assembly of claim 11 wherein the frame is secured to the gasket between the first lateral surface and the second lateral surface.

13. The assembly of claim 11 wherein the gasket further includes a fourth wing disposed below the second lateral surface and adjacent to the third wing.

14. The assembly of claim 11 wherein the wings are composed of a flexible material.

15. A skylight assembly comprising:

a frame;

a gasket secured to the frame, the gasket comprising a first lateral surface and a second lateral surface disposed below the first lateral surface, the first lateral surface including a first end and a second end wherein the first end is positioned adjacent to the frame, the first lateral surface further including respective first, second, and third longitudinal members, the first longitudinal member being disposed at the first end of the first lateral surface and extending upwardly from the first lateral surface, the third longitudinal member being disposed at the second end of the first lateral surface and including an upwardly extending lea from the first lateral surface, the second longitudinal member including an upper end and a lower end and intersecting the first lateral surface between the first and third longitudinal members, the second lateral surface extending outwardly from the lower end of the second longitudinal member, wherein the second lateral surface has a first end and a second end, the second end of the second lateral surface is adjacent to the lower end of the second longitudinal member, the first end of the second lateral surface includes a downward sloped leg; and a lens residing between the frame and the gasket.

16. A skylight assembly comprising:

a frame;

a gasket secured to the frame, the gasket comprising a first lateral surface and a second lateral surface disposed below the first lateral surface, the first lateral surface including a first end and a second end wherein the first end is positioned adjacent to the frame, the first lateral surface further including respective first, second, and third longitudinal members, the first longitudinal member being disposed at the first end of the first lateral surface and extending upwardly from the first lateral surface, the third longitudinal member being disposed at the second end of the first lateral surface and including an upwardly extending lea from the first lateral surface, the second longitudinal member including an upper end and a lower end and intersecting the first lateral surface between the first and third longitudinal members, the second lateral surface extending outwardly from the lower end of the second longitudinal member, wherein the first longitudinal member further includes an arced leg, the arced leg extending upward; and a lens residing between the frame and the gasket.

17. A skylight assembly comprising:

a frame;

a gasket secured to the frame, the gasket comprising a first lateral surface and a second lateral surface disposed below the first lateral surface, the first lateral surface including a first end and a second end wherein the first end is positioned adjacent to the frame, the first lateral surface further including respective first, second, and third longitudinal members, the first longitudinal member being disposed at the first end of the first lateral surface and extending upwardly from the first lateral surface, the third longitudinal member being disposed at the second end of the first lateral surface and including an upwardly extending lea from the first lateral surface, the second longitudinal member including an upper end and a lower end and intersecting the first lateral surface between the first and third longitudinal members, the second lateral surface extending outwardly from the lower end of the second longitudinal member, wherein the second lateral surface has a first end and a second end, the second end of the second lateral surface is adjacent to the lower end of the second longitudinal member, the first end of the second lateral surface includes a downward sloped leg; and a lens residing between the frame and the gasket.

18. The assembly of claim 11 wherein the first longitudinal member, the second longitudinal member, and the first lateral surface form a first gutter, and wherein the second longitudinal member, the third longitudinal member, and the first lateral surface form a second gutter.

19. A skylight assembly comprising:

a frame;

a gasket secured to the frame, the gasket comprising a first lateral surface and a second lateral surface disposed below the first lateral surface, the first lateral surface including a first end and a second end wherein the first end is positioned adjacent to the frame, the first lateral surface further including respective first, second, and third longitudinal members, the first longitudinal member being disposed at the first end of the first lateral surface and extending upwardly from the first lateral surface, the third longitudinal member being disposed at the second end of the first lateral surface and including an upwardly extending lea from the first lateral surface, the second longitudinal member including an upper end and a lower end and intersecting the first lateral surface between the first and third longitudinal members, the second lateral surface extending outwardly from the lower end of the second longitudinal member, wherein the first longitudinal member, the second longitudinal member, and the first lateral surface form a first gutter, and wherein the second longitudinal member, the third longitudinal member, and the first lateral surface form a second gutter;

a lens residing between the frame and the gasket; and at least four corners and at least four wicks, the gutters defining gaps residing at each of the corners of the skylight assembly, wherein each of the at least four wicks resides in a gap.

20. A method of mounting a skylight system comprising:

providing skylight assembly components including:

an upper frame, the upper frame comprising a downwardly extending upper channel and inside and outside legs bordering the channel;

a lower frame, the lower frame comprising an upwardly extending lower channel;

a connector clip;

a gasket, the gasket comprising a first gutter channel and a second gutter channel; and a lens, and mounting the skylight assembly components, including the steps of:

securing the lower frame to the gasket;

securing the connector clip within the lower channel of the lower frame;

securing the lens above the first and second gutter channels of the gasket; and inserting the inside leg of the downwardly extending upper channel into the connector clip secured within the lower channel of the lower frame.

21. The system of claim 20 further comprising the step of securing the lower frame to a curb positioned on the roof of a structure.

22. A skylight assembly comprising:

an upper frame, the upper frame comprising a downwardly extending upper channel and inside and outside legs bordering the channel;

a lower frame, the lower frame comprising an upwardly extending lower channel;

a connector clip, the connector clip secured within the lower channel of the lower frame;

a gasket, the gasket including a first gutter channel and a second gutter channel, the gasket carried by the lower frame; and a lens, the lens disposed above the first and second gutter channels of the gasket, wherein the inside leg of the downwardly extending upper channel interfits with the connector clip.

* * * * *